United States Patent [19]

Noh

[11] Patent Number: 4,787,220

[45] Date of Patent: Nov. 29, 1988

[54] AGITATOR FOR A FULL AUTOMATIC WASHER

[75] Inventor: Yang H. Noh, Pusan, Rep. of Korea

[73] Assignee: Gold Star Co., Ltd., Seoul, Rep. of Korea

[21] Appl. No.: 55,262

[22] Filed: May 29, 1987

[30] Foreign Application Priority Data

May 31, 1986 [KR] Rep. of Korea ..... 7838/1986

[51] Int. Cl.[4] ..... D06F 17/10

[52] U.S. Cl. ..... 68/134

[58] Field of Search ..... 68/133, 134

[56] References Cited

U.S. PATENT DOCUMENTS

| | | | |
|---|---|---|---|
| 2,212,373 | 8/1940 | Litle, Jr. | 68/134 |
| 2,929,234 | 3/1960 | Castricone | 68/134 X |
| 3,464,239 | 9/1969 | Hubbard et al. | 68/134 |
| 4,129,018 | 12/1978 | Platt | 68/134 |
| 4,137,737 | 2/1979 | Robandt, II et al. | 68/134 |

FOREIGN PATENT DOCUMENTS

| | | | |
|---|---|---|---|
| 1048397 | 3/1986 | Japan | 68/134 |

*Primary Examiner*—Philip R. Coe

*Attorney, Agent, or Firm*—Cushman, Darby & Cushman

[57] ABSTRACT

The invention relates to an agitator with an improved structure and more particularly to a spiral ramp agitator used in the full automatic washer. The agitator of the present invention is composed of such improved structure that the vanes are formed in a particular shape increasing gradually in the width and thickness downwardly from the top to the lower end and have the spaces in the inner parts, the front and rear parts of the vanes have different gradient and curvature, a step is formed between the bell-shaped expansion part and the circular base and accordingly the bell-shaped expansion part and the circular base are formed in a shape of step, and the stirring projections extended in one piece along the lower end of each vane are arranged radially on the circular base. Furthermore, the agitator of the invention has advantages in that its mechanical strength is increased preeminently so that its use life is prolonged and its washing power is improved.

8 Claims, 7 Drawing Sheets

FIG,1
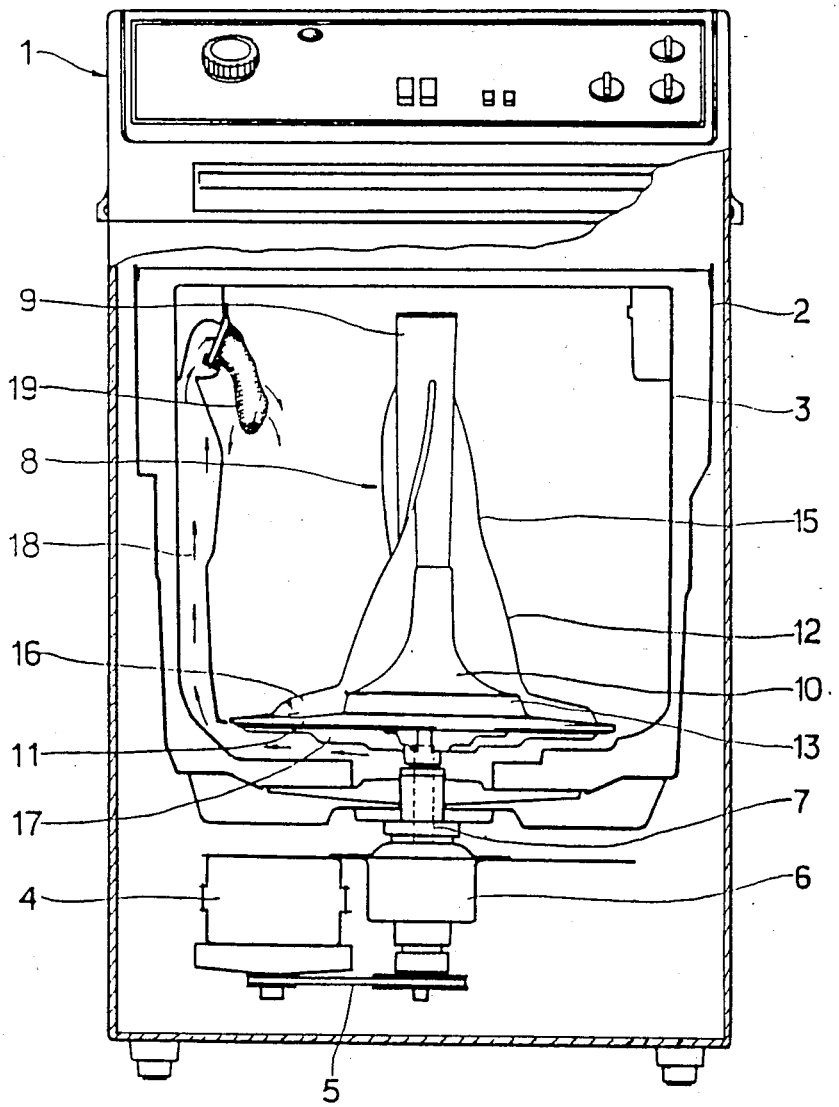

FIG, 2
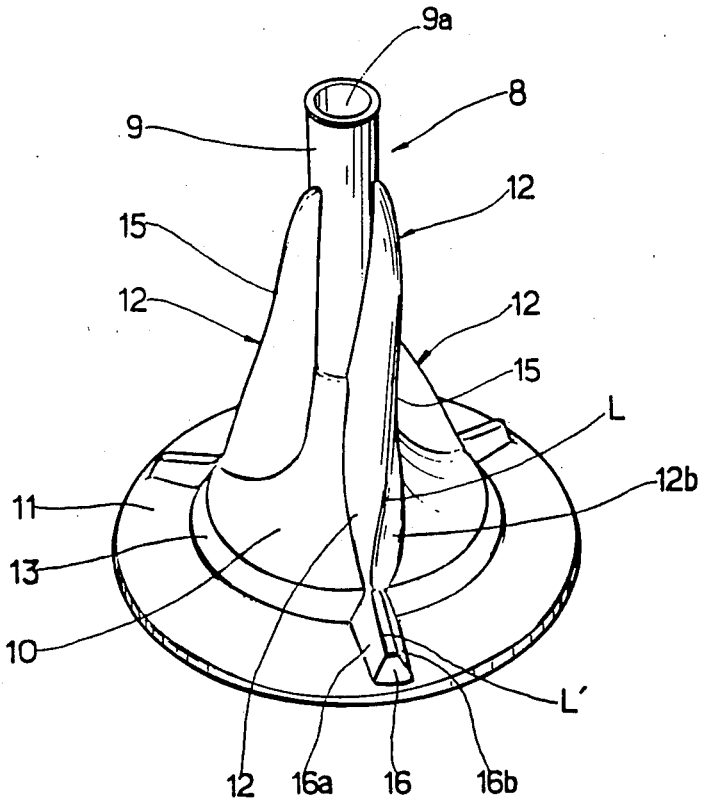

FIG, 3
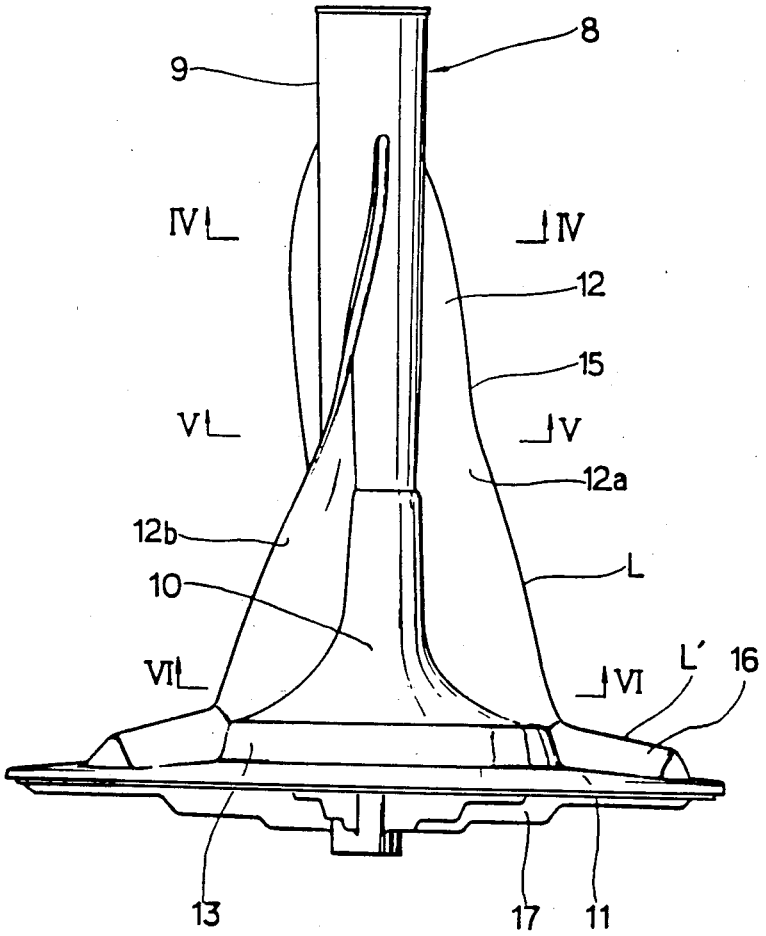

FIG, 4
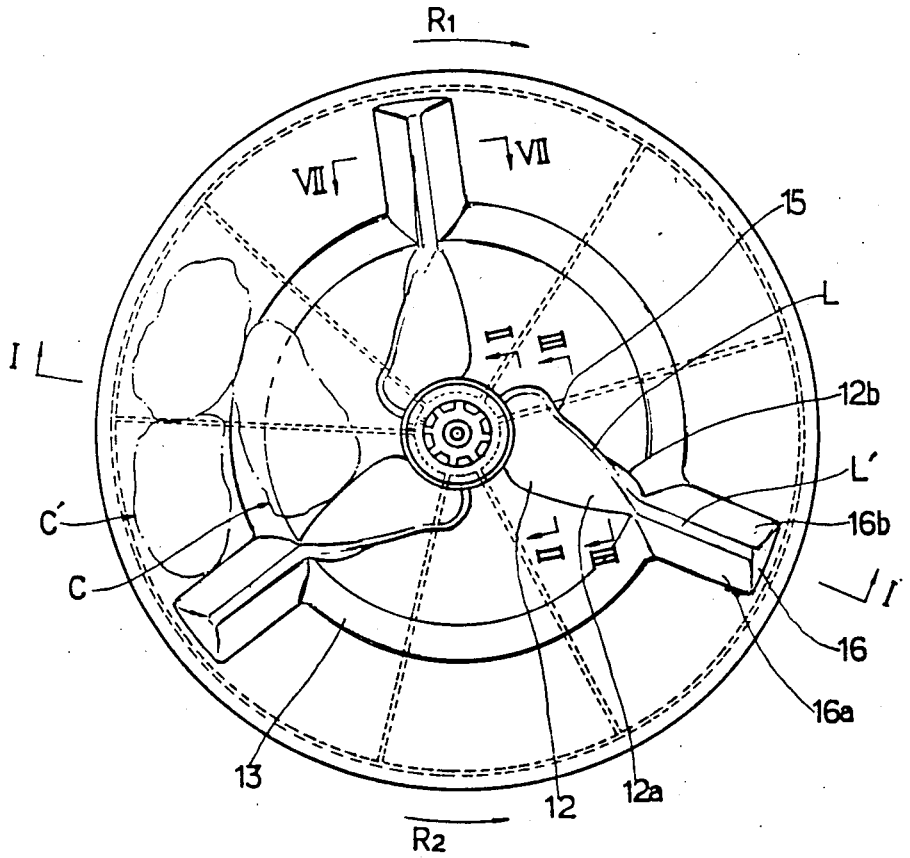

FIG, 5
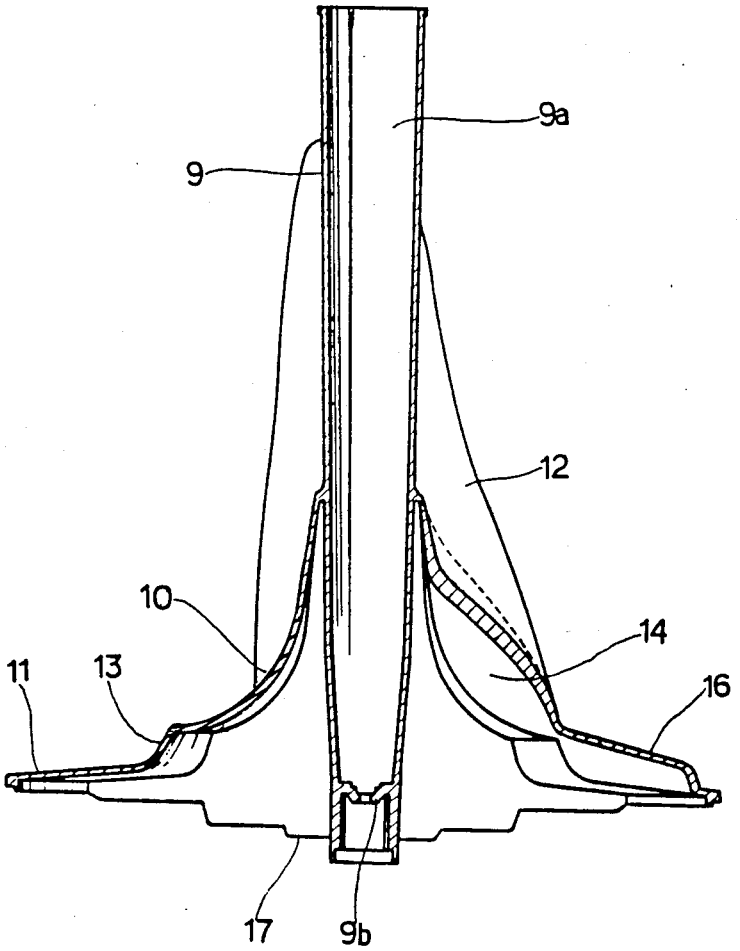

FIG,6 A
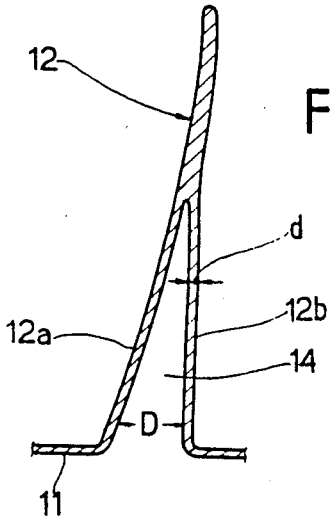
FIG,6 B
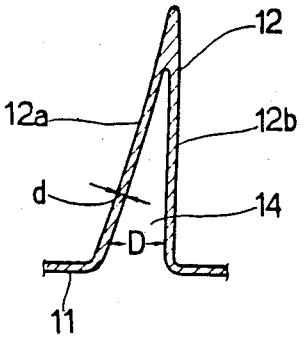
FIG,8
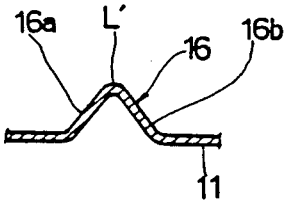

FIG, 7 A
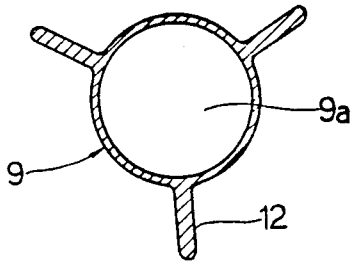
FIG, 7 B
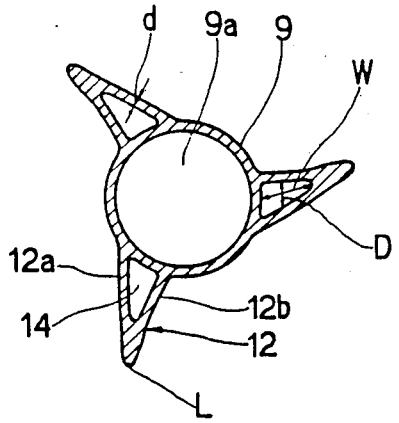
FIG, 7 C
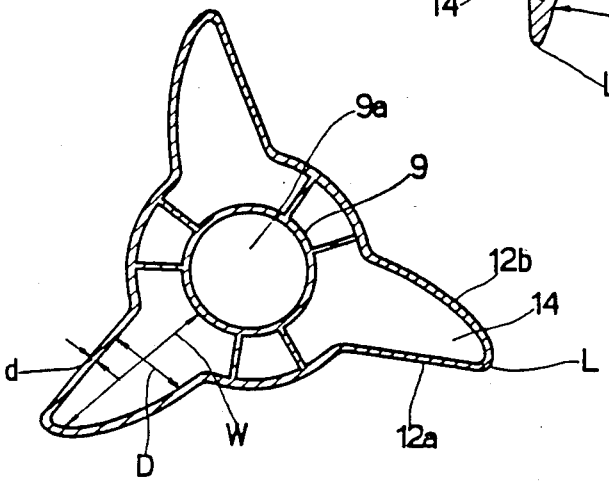

AGITATOR FOR A FULL AUTOMATIC WASHER

FIELD OF THE INVENTION

The present invention relates to an agitator having an improved structure, and particularly to a spiral ramp agitator used in a full automatic washer, etc.

BACKGROUND OF THE INVENTION

The spiral ramp agitator for washer is generally of such a structure that a central shaft is set up vertically on the washing axis of the washer, a circular base is formed in one piece at the lower part of the central shaft, and several spiral ramp vanes of identical shapes are formed in one piece protruded between the central shaft and the base.

According such spiral ramp agitator, the washing is effected in such a way that as the washing axis rotates forwards or backwards by means of the driving force of a driving motor, the agitator fixed to the washing axis rotates forwards or backwards, and the wash water and articles filled in the intub are meanwhile agitated upwards, downwards, inwards and outwards in the intub.

Thus, according to an agitator washer in which wash is carried out by an agitating action of the agitator, the washing power is determined by the structure of agitator, speed and frequency of rotation, and the rotation speed and frequency of the agitator are related directly to its structure. For this reason, the performance of such a washer depends largely on the structure of the agitator.

Therefore, the agitator must have a shape suitable for improving the washing power on the one hand, and a high mechanical strength enough not to be easily damaged by any impact of the wash articles at the time of washing and a structure by which the wash articles are not damaged and preferably which is manufactured easily, on the other hand.

Up to now, many attempts have been made to change the shapes and structures of the agitators in various forms for the purpose of satisfying the above mechanical requirement, but none of them has obtained a result sufficient to satisfy concurrently the matters, such as improvement of washing power, high mechanical strength, protection of the wash articles from damage, reduction of load, easiness of manufacture, etc.

The conventional agitators as described in the U.S. Pat. No. 3,464,239 and No. 3,726,114 have, for example, disadvantage in that since the spiral ramp vanes formed in one piece at regular intervals on the periphery of the central shaft are uniformly formed thinly on the whole from the top toward the bottom, they are weak in strength and unable to stand for a long time any impact applied at the time of washing. Furthermore, they have also problems that some of the vanes being set up perpendicularly on the circular base, a very large load is imposed on the vanes, and the wash articles are caught on thin edge lines of each vane and damaged or even torn in some worse cases. In addition, such agitators has a problem in that it is impossible to expect a high washing effect due to a structural defect in each part of the agitator including the vanes.

In addition to the above-mentioned patents, such agitators of this type as disclosed in the U.S. Pat. Nos. 1,897,239, 1,923,580, 2,042,578, 2,150,654, 3,117,434 and the German Pat. No. 824,333, etc. are also included in the category similar to agitators as described in the above-mentioned patents, and they have also similar problems and defects. Moreover, some of them are so complex in structure that they lack a practicability.

SUMMARY OF THE INVENTION

It is the object of the present invention to provide an agitator of the full automatic washer which can solve such problems and defects in the above-mentioned conventional agitators.

It is another object of the present invention particularly to provide an agitator of the full automatic washer which is not damaged by any impact applied thereto in the course of washing because the vanes of agitator are increased gadually in the width and thickness descending from the top to the lower end so that they have a strong resistance to impact.

It is further another object of the present invention to provide an agitator of the full automatic washer which has space parts formed in its vanes so as to mold the vanes easily and to manufacture them without any deformation when the agitator of synthetic resin is molded by injection.

It is further another object of the present invention to provide an agitator of the full automatic washer in which the bell-shaped expansion part and the base are formed in the shape of step with a step difference by a step formed between them so that the phenomena to concentrate the wash articles inwards in the direction of the central shaft and to be overloaded in the upper part of the intub due to their rapid rising, are eliminated, and a stirring protrusion formed between the peripheral edge of the base and the step forming the lower end of the said bell-shaped expansion part makes the wash articles in the lower part of the intub to circulate more smoothly and the washing power is thereby improved.

To this end, the invention provides and agitator of the full automatic washer in which several spiral ramp vanes formed in one piece on the central shaft and the peripheral side of the bell-shaped expansion part is formed to be broadened gradually in the width and at the same time to be thickened gradually descending from the top to the lower edge, and a space is formed inside of each vane.

The invention provides also an agitator of the full automatic washer in which a step for restricting the phenomenon to concentrate the wash articles in the inner direction when they are rising, is formed between the bell-shaped expansion part and the base, and a stirring protrusion applying an impact to the wash articles in the lower part of the intub to circulate them is extended from the lower edge of the spiral ramp vane and formed radially between the said step and the peripheral edge of the base.

The above-mentioned objects, other objects, characteristics and advantages of the invention will become more apparent through a detailed description of the following embodiments with reference to the accompanying drawings.

BRIEF DESCRIPTION OF THE DRAWINGS

FIG. 1 is a longitudinal cross sectional view of a full automatic washer mounted therein an agitator of the invention;

FIG. 2 is a perspective view illustrated the construction of the agitator according to the invention;

FIG. 3 is an elevation view of the agitator of FIG. 2;

FIG. 4 is an plan view of the agitator of FIG. 2;

FIG. 5 is a sectional view of the agitator taken on the line I—I in FIG. 4;

FIGS. 6(A) and (B) are sectional views of the agitator taken on the lines II—II and III—III in FIG. 4;

FIGS. 7(A) to (C) are sectional views of the agitator taken on the lines IV—IV, V—V, VI—VI in FIG. 3;

FIG. 8 is a sectional view of the agitator taken on the line VII—VII in FIG. 4.

DETAILED DESCRIPTION OF THE INVENTION

In FIG. 1, the reference number 1 represents a full automatic washer carrying out concurrently the washing and the dehydration, 2 represents an out-tub to be mounted in the washer 1, and 3 represents an in-tub to be mounted in the out-tub 2. In the in-tub 3 is mounted vertically a rotation axis 7 of a power sectional transmission unit 6 driven by the driving force of a driving motor 4 which is transmitted through a belt 5, and to the rotation axis 7 is mounted an agitator 8 according to an embodiment of the invention in such manner as to be rotated in the in-tub 3.

FIG. 2, FIG. 3 and FIG. 4 illustrate in detail the agitator 8 formed according to an embodiment of the invention. The agitator 8 comprises a central shaft 9 fixed vertically to the said rotation axis (hereinafter referred to as "washing axis") 7, a circular base 11 coupled in one piece at its upper end with the middle lower part of the central shaft 9, and several spiral ramp vanes 12 (three are shown in the drawings).

The central shaft 9, as shown in a longtudinal cross sectional view of FIG. 5, is formed in an upper wide and lower narrow tubular body having a hollow part 9*a*, at the lower end of which is formed with a fixture part 9*b* which the upper end of the said washing axis 7 is inserted in and secured to, and at the open upper part of which a lid is covered, but this is not illustrated in the drawing.

The bell-shaped expansion part 10 coupled in one piece at its upper end with the middle lower part of the said central shaft 9 is expanded in the peripheral surface of the middle part to a smoothly curved one, and its upper part forms a steep slope.

At the lower end of the bell-shaped expansion part 10 there is formed in a predetermined width with a step 13 forming a slope steeper than the middle part of the expansion part 10, the lower end of which is incorporated in the circular base 11 so that the expansion part 10 and the circular base 11 form a step-shaped step difference.

Several spiral ramp vanes 12 are disposed so as to face to three directions maintaining an equal distance to each other from the central point of the base 11, and the lower end of each vane 12 is incorporated in the expansion part 10 and its upper end is incorporated in the central shaft 9, and they are of shape increasing gradually in the width and thickness descending from the top to the lower end. The front and rear parts 12*a*, 12*b* of each vane 12 is of shape winding up spirally forming an inclined plane having a proper angle of inclination to the central shaft 9, and the inner edge of each vane 12 is connected in one piece with the peripheral side of the central shaft 9, while its outer edge forms a spirally curved edge-line L.

As shown in FIG. 5, FIG. 6 and FIG. 7, the said vanes 12 in which is formed with a space part 14 open at its lower end to the lower part of the base 11 and in which a core is inserted at the time of injection molding, is formed in such a way that the front and rear parts 12*a*, 12*b* of each vane 12 have approximately equal thickness d.

Each space part 14 is of shape substantially similar to that of each vane 12, and its width W is broadened gradually descending from the top to the lower end in the same way as the vane 12, and likewise its thickness D is thickened gradually descending from the top to the lower end, while becomes gradually thinner from the inside toward the outside.

Each vane 12 is also inclined smoothly in its lower side, but more steeply in its upper side on the basis of the inflection part 15 of its upper side, and as the front and rear parts 12*a*, 12*b* of the upper side of each vane 12 are combined in one piece on the basis of the inflection part 15, the space part 14 is formed only in the lower side of each vane 12. The front part 12*a* of the lower side of each vane 12 is formed in a substantially flat surface, the rear part 12*b* is formed in a curved surface, and the edge-line L is formed so as to have a substantially C-shaped cross section.

At the lower parts of thus formed vanes 12 the stirring projections 16 are extended radially to be integral with the base 11. Each stirring projection 16 has the front and rear inclined parts 16*a*, 16*b* extending integrally from the front and rear parts 12*a*, 12*b* of the said vane 12. The inner edges of the front and rear inclined parts 16*a*, 16*b* are connected integrally to the peripheral surface of expansion part 10 and the base 11, and their outer edges form an edge-line L' connected to the edge-line L of the said vanes 12. The edge-line L' has a very gentle gradient substantially equivalent to that of the circular base 11.

As referred to the bottom of the agitator 8, multiple of radial reinforcing ribs 17 are integral with the central shaft 9, expansion part 10 and base 11 so as to play a reinforcing role, and at the same time they are destined to produce a centrifugal water flow at the time of washing and to make such water flow circulate in the wash water circulating path 18 between the in-tub 3 and the out-tub 2.

The reference number 19 in the drawings represents a gathering net mounted on the upper part of the in-tub 2 for gathering the naps contained in the circulating water running in the circulating path 18.

According to the agitator 8 of the invention mounted on the washing axis 7, the wash articles are risen along the front part 12*a* of each vane 12 and at the same time a rotating and agitating action takes place by the edge-line L as the washing axis 7 rotates in the forward direction, that is, in the direction indicated by the arrow R1. On the contrary, when the washing axis 7 rotates in the backward direction, that is, in the direction indicated by the arrow R2, the wash article are descended along the rear part 12*b* of each vane 12 and at the same time they are subject to a rotating and agitating action by the edge-line L. Accordingly the wash articles are flowed actively upward, downward, inward and outward of the in-tub 3, and they are washed therethrough. Such washing action is similar to that of the ordinary agitator washer.

On the other hand, the agitator 8 of the invention is in such a shape that each vane 12 is formed to be broadened in its width gradually from the top toward the lower end and to be thickened in its thickness so that each vane 12 has very strong resistance to an impact, and there is, therefore, no possibility that the agitator 8 is damaged due to an impact applied by the wash water and articles in the course of washing. Consequently the use life of the agitator is prolonged preeminently compared with any conventional agitator in which several vanes have the equal thickness through the full length.

According to the U.S. Pat. No. 3,464,239 wherein the lower side of the vane is set up perpendicularly to the base and U.S. Pat. No. 3,726,114 wherein the vertical vane is set up vertically on the external edge of the ramp vane, the load applied to the vane at the time of washing is very large, while the agitator of the invention is of structure inclined from its lower end on which the vane 12 is integral with the bell-shaped expansion part 10, and the load applied to the vane 12 at the time of washing is reduced remarkably.

Furthermore, it is possible to reduce a phenomenon that the wash articles are entangled with each other or caught by the vanes 12 due to such structure of vanes 12.

According to the agitator of the invention, the resistance of the vanes 12 to an impact is very strong and the load applied to the vanes 12 is light so that the agitator may be driven so as to rotate in forward and backward direction at the rotating speed of about 100–250 r.p.m. and in the relatively long rotating period of 0.7–1.0 second (ON) and 0.4–0.6 second (OFF).

According to the conventional agitators, when they rotate for a long time, the wash articles are wound on the external edges of vanes and subject to lots of load, and in a worse case, they are stretched to be torn. For this reason, the conventional agitators rotate in the short rotating period of less than 0.5 second. According to the invention, as compared with the conventional agitators, the load applied to the agitator and the phenomenon that the wash articles are entangled, are reduced and it is possible to rotate the agitator for a long period of agitating time. Accordingly the wash articles flow actively by the smooth agitating action of the agitator, and it contributes to the improvement of the washing power.

In driving the agitator of the invention, the flow of wash articles and the load exerted on the agitator vary actually at the time of forward and backward rotation due to the different shapes of the front and rear parts 12*a*, 12*b* of the vanes 12 of the agitator. Therefore it is possible to remove the orientating property depending on the shape of vane 12, namely the property by which the flow of wash articles and the load exerted on the agitator vary when the agitator rotates forwards and backwards, and to carry out a uniform washing, by driving the agitator with the forward and backward rotating times and the stop time set differently.

For example, the orentating property of the agitator is removable in such manner that the agitator is driven with the times set as follows: forward 1 sec.→stop 0.5–0.7 sec.→backward 0.8–1 sec.→stop 0.4–0.5 sec.

Moreover, according to the invention, it is also possible to drive the agitator with a rotating period set to a time shorter than that of the conventional ones, and in such case it is also convenient to set the rotating and stop time to be equal at the time of the forward and backward rotations.

Furthermore, according to the conventional agitators, when the agitator rotates forwards in the direction R1, and the wash articles rise up along the front part 12*a* of the vane 12, some wash articles C close to the underside of the vane 12 among those existing in the lower side of the in-tub 3 are caught in the underside of the vane 12 and the rear parts of such wash articles C are concentrated toward the central shaft 9 by the pressure and inertia produced by the surrounding wash articles, while according to the agitator of the invention, the step 13 is formed between the bell-shaped expansion part 10 and the circular base 11, and the bell-shaped expansion part 10 and the circular base 11 form a step-shaped step difference so that it eases such phenomenon and reduces the damage of wash articles and the increase of load.

The conventional agitators have problems that since the lower end of each vane is extended obliquely to the circular base, the wash articles in the lower side of the in-tub were concentrated in the lower end of the vane, and in the part between the lower ends of the vanes and the peripheral edge of the circular base, that is, in the part without a vane, the wash articles could not rise actively and remained in the underside of the in-tub, so that it was difficult to expect uniform washing. According to the agitator of the invention, however, the stirring projection 16 is extended along the lower end of each vane 12, disposed radially on the base 11, and has the front and rear inclined surfaces 16*a*, 16*b* on both-sides, so that when the agitator rotates forwards and backwards, the stirring projection 16 rotates together and applies a force to the wash articles gathered and staying in the lower end of each vane 12, namely in the area between the step 16 of the expansion part 10 and the peripheral edge of the base 11, whereby the wash articles flow in the rotating direction of the agitator and bounce upwardly along the inclined surface 16*a* of the stirring porjection 16 and then rise up along the front part 12*a* of the vane 12 so that the load concentrated in the lower end of the vane 12 is dispersed and massive force is not applied to a certain wash article, which facilitates the flow of wash articles and carries out a uniform washing. Even when the agitator rotates backwards and the wash articles descend along the rear part 12*b* of each vane 12, the stirring projection 16 rotates together with the agitator and strikes the wash articles so that the wash articles flow actively in the lower part of the in-tub 3.

According to the conventional agitators, the vanes are formed spirally and obliquely so as to make the wash articles rise and descend, but when the upper side of the vane is formed obliquely, the wash articles are caught by the appear side of the ramp vane, and a smooth descending action is hindered. According to the agitator of the invention, the upside vane 12 of the inflection part 15 is formed more steeply than the underside, substantially in perpendicular to the central shaft 9, so that the phenomenon the wash articles are caught by the upside of the vane 12 at the time of backward rotation of the agitator, is reduced.

Particularly, according to the agitator of the invention, there is formed in the inside of each vane 12 with the space part 14 open to the lower part of the circular base 11 so that it is possible to set up and mould a core in the space part 14 at the time of injection moulding of the agitator 8 with the synthetic resin. Accordingly it is also possible to manufacture easily as designed without any deformation the vane 12 which is increased gradually in the width and thickness downwardly from the top to the lower end, and different in the gradients and curvatures of the front and rear parts 12*a*, 12*b*.

The agitator of the invention as described above is formed of such improved structure that the vanes are formed in a particular shape increasing gradually in the width and thickness descending from the top to the lower end and have the spaces in the inner parts, the front and rear parts of the vanes have different gradient and curvature, a step is formed between the bell-shaped expansion part and the circular base and accordingly the bell-shaped expansion part and the circular base are formed in a shape of step, and the stirring projections extended in one piece along the lower end of each vane are arranged radially on the circular base. Furthermore the agitator of the invention has advantages in that its mechanical strength is increased preeminently so that its use life is prolonged and its washing power is improved.

What is claimed is:

1. An agitator for a full automatic washer, which comprises:

a central hollow shaft having at a lower end thereof a fixture part for fixing to a washing axis of the washer, a bell-shaped expansion part connected at an upper end thereof in one piece to a peripheral surface of a lower mid-portion of the central shaft, a circular base connected in one piece to a lower end of said expansion part, and a plurality of vanes formed integrally with said central shaft on a peripheral surface of the expansion part and inclined relative to a vertical plane through said central shaft, a step of a predetermined width being formed between said bell-shaped expansion part and the circular base so that the bell-shaped expansion part and the circular base have a step-shaped step difference, each vane being formed such that a width and a thickness thereof increase gradually from a top thereof to a lower end thereof, each vane having a substantially hollow interior portion with an open lower end.

2. An agitator as claimed in claim 1, further comprising a stirring projection extending radially from the lower end of each vane, each said stirring projection being formed integrally with said circular base.

3. An agitator as claimed in claim 2, wherein said stirring projections each include front and rear inclined parts extending in one piece along front and rear parts of each vane, a side edge of said front and rear inclined parts being integral with the expansion part and a peripheral surface of the base, external edges of said front and rear inclined parts forming an edge-line L′ connected with an edge-line L of said vanes, and the edge-line L′ being formed in a gradient substantially similar to a gradient of the circular base.

4. An agitator as claimed in claim 1, a width W of the hollow interior portion of each said vane is formed so that it is broadened gradually downwardly from the top of each vane to the lower end thereof, a thickness D increasing gradually from the top to the lower end, while the thickness D decreases gradually from the inside to the outside, and each vane has front and rear parts formed so as to have substantially equal thicknesses.

5. An agitator as claimed in claim 4, wherein the front and rear parts of each vane are combined in one piece at an upper part, said upper part having a gradient smoother than a gradient of the lower part, each said vane having an inflection part intermediate said upper part and said lower part, and the hollow portion is formed only in the lower part of each vane.

6. An agitator as claimed in claim 1, wherein said vanes become thinner gradually from an inner edge to an outer edge so that an edge-line formed by the outer edges of the vanes has a C-shaped section.

7. An agitator as claimed in claim 1, wherein a driving and rotating period is set by 0.7–1.0 second for a forward and backward rotation and 0.4–0.6 second for a stop time.

8. An agitator as claimed in claim 1, wherein a rotating speed is set by 100–250 r.p.m.

* * * * *